United States Patent [19]

Tokuno et al.

[11] Patent Number: 4,458,851

[45] Date of Patent: Jul. 10, 1984

[54] MILL ROLL STAND

[75] Inventors: Masateru Tokuno, Nishinomiya; Tetsuya Sawada, Kyoto; Yoshihiro Ishii, Yao, all of Japan

[73] Assignee: Rengo Co., Ltd., Osaka, Japan

[21] Appl. No.: 431,092

[22] Filed: Sep. 30, 1982

[30] Foreign Application Priority Data

Sep. 30, 1981 [JP] Japan ..... 56-157953

[51] Int. Cl.[3] ..... B65H 75/02

[52] U.S. Cl. ..... 242/55; 242/68; 242/68.4; 242/79

[58] Field of Search ..... 242/54 R, 68, 68.1, 242/68.4, 79; 72/29, 225, 227; 198/341, 489, 598, 651; 414/738

[56] References Cited

U.S. PATENT DOCUMENTS

| | | | |
|---|---|---|---|
| 2,490,685 | 12/1949 | Greene | 242/58.6 |
| 2,802,586 | 8/1957 | Wingard | 198/341 |
| 2,973,914 | 3/1961 | Beninger | 242/58 |
| 3,837,591 | 9/1974 | Clarke | 242/68.4 |
| 3,955,770 | 5/1976 | Offermann | 242/68.4 |
| 4,102,511 | 7/1978 | Krimsky et al. | 242/64 |
| 4,105,172 | 8/1978 | Petros | 242/78.1 |

FOREIGN PATENT DOCUMENTS

| | | |
|---|---|---|
| 378993 | 9/1932 | United Kingdom . |
| 1192024 | 5/1970 | United Kingdom . |
| 1349991 | 4/1974 | United Kingdom . |

*Primary Examiner*—Leonard D. Christian

*Attorney, Agent, or Firm*—Wenderoth, Lind & Ponack

[57] ABSTRACT

A mill roll stand for supporting at least one roll of paper or similar web-like material. The stand has a pair of endless members arranged with a spacing therebetween, at least one pair of bases mounted on the endless members so as to be opposed to each other, at least one pair of center shafts supported in the bases so as to be laterally slidable into and out of the center hole in the roll to be supported to hold the roll, a drive for driving the endless members in a synchronous manner, and a guide for guiding at least part of the endless members so that they will run in a predetermined route even under the weight of the web rolls.

2 Claims, 9 Drawing Figures

MILL ROLL STAND

The present invention relates to a mill roll stand for supporting rolls of paper, sheet steel, plastic film or a similar web-like material while the web from the roll is being supplied to some processing machine such as a corrugating machine.

Generally, a mill roll stand must meet the following requirements.

The first requirement comes from the fact that the rolls to be supported sometimes have a considerable weight (e.g. a roll for the production of corrugated fiberboard weighs about 4,000 Kg at maximum). The mill roll stand has to support such heavy rolls without overstrain and to allow the roll to turn smoothly.

The second requirement for a mill roll stand is that both the mounting of a new roll on the roll stand and the removal of the old roll therefrom is possible either at the operator's side only of the machine or at its drive side only. If the roll has to be carried to the machine from one side of the machine and be carried out from the other side, a long distance may have to be travelled to carry rolls from or to the roll storage station because of the considerable length of the machine (about 100 meters in the case of corrugating machines). Further, in such a case, a considerable space is required at both sides of the machine for carrying, mounting and removal of the rolls.

The third requirement comes from the fact that the rolls to be supported have a large diameter (up to about 1,500 mm in the production of corrugated fiberboard). Generally, there is only a limited space left around and over the mill roll stand because it is used with other existing machines. Thus, it is required that the mill roll stand be able to support as many rolls as possible in such a limited space available.

This third requirement comes also from the fact that several rolls have to be in a standby position in order to carry out production speedily according to a work schedule without a long time delay between lots. Usually, corrugated board manufacturers get a variety of orders which widely vary in the width, length, and quality of the corrugated fiberboard. They make a work schedule for each day on the basis of the orders and change lots according to the work schedule. For small size lots, the production length for one lot is sometimes not longer than 1,000 meters. In such cases, splicings have to be done every several minutes because an ordinary corrugating machine has a production speed of about 200 meters per minute. Splicing has also to be done at a short interval if the web is supplied from partially used rolls having not much web left. If the appropriate rolls are not prepared in a predetermined order, the production speed must be decreased to give a sufficient time for the preparation of splicing. To avoid such inconvenience, it is required that a mill roll stand support several rolls.

The fourth requirement is that a mill roll stand be constructed so that a roll is taken thereinto from one direction and taken out of it in another direction. This is because several rolls are usually arranged beside it in sequence according to the work schedule and they are in the way in taking out the partially used roll.

Three conventional mill roll stands are shown in FIGS. 1 to 3. The one in FIG. 1 is a movable type having a carrier 31 rolling on rails 30, the carrier being provided with support arms 32. FIG. 2 shows a stationary type having a support base 33 provided with a pair of support arms 32 extending in two opposite directions. FIG. 3 shows a swivel type having a support base 34 provided with a pair of support arms 32. To allow the support arms to swivel, a pit 35 has to be provided in the floor.

In the case of the movable type, two units are used, arranged side by side. With this type, the third requirement cannot be met and it is difficult to mount rolls quickly and put several rolls in a standby position. Neither the second nor the fourth requirement can be met. Further, extra time and power are required to move the carrier 31 between the roll storage and the machine. A further shortcoming is that each carrier can support only one roll.

With the stationary type, the third requirement cannot be met and considerable time is taken to bring rolls to a standby position and only two rolls can be supported. This type cannot meet either of the second and fourth requirements, either.

With the swivel type, it is necessary to provide a pit 35 in the floor and/or to have a high ceiling. This increases the cost. The pit causes inconvenience in mounting the roll on and moving it from the roll stand.

A shortcoming common to these three types is that the support arms 32 and the mechanism for swiveling the arms are too strained under the weight of heavy rolls for smooth movement.

An object of the present invention is to provide a mill roll stand which meets all of the abovementioned requirements and obviates such shortcomings.

In accordance with the present invention, there is provided a mill roll stand for supporting at least one roll of paper or similar web-like material, comprising a pair of endless members arranged with a spacing therebetween, at least one pair of bases mounted on said endless members so as to be opposed to each other, at least one pair of center shafts supported in said bases so as to be laterally slidable into and out of the center hole in the roll to be supported to hold said roll, drive means for driving said endless members in a synchronous manner, and guide means for guiding at least part of said endless members so that they will run in a predetermined route even under the weight of said web rolls.

Other objects and advantages of the present invention will become apparent from the following description taken with reference to the accompanying drawings, in which.

Figure 1:
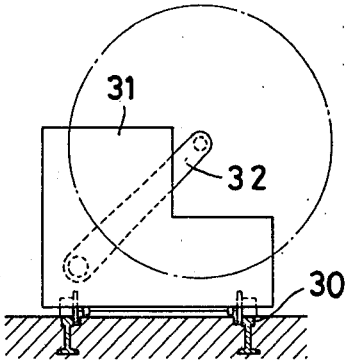
FIGS. 1–3 are side views of the conventional mill roll stands.
Figure 2:
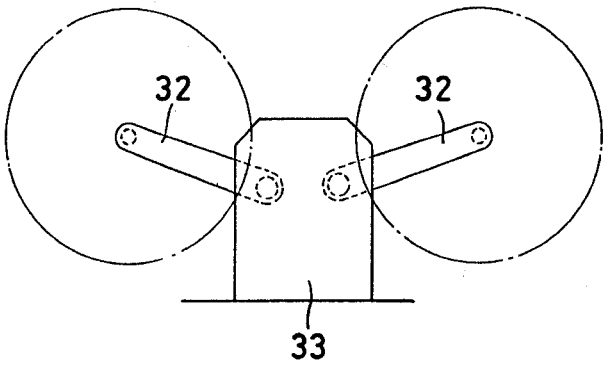
Figure 3:
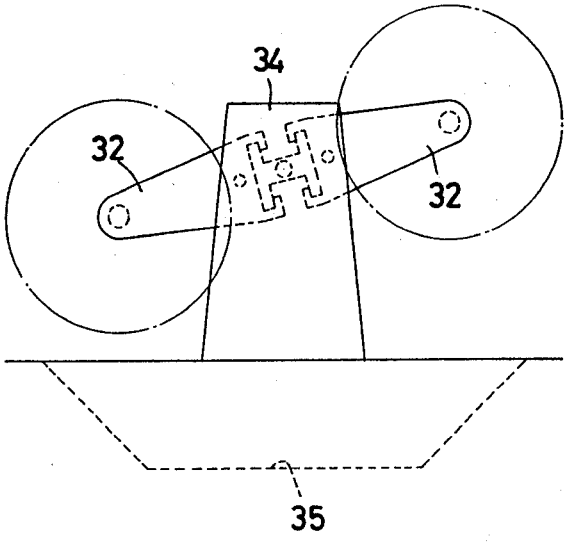
Figure 4:
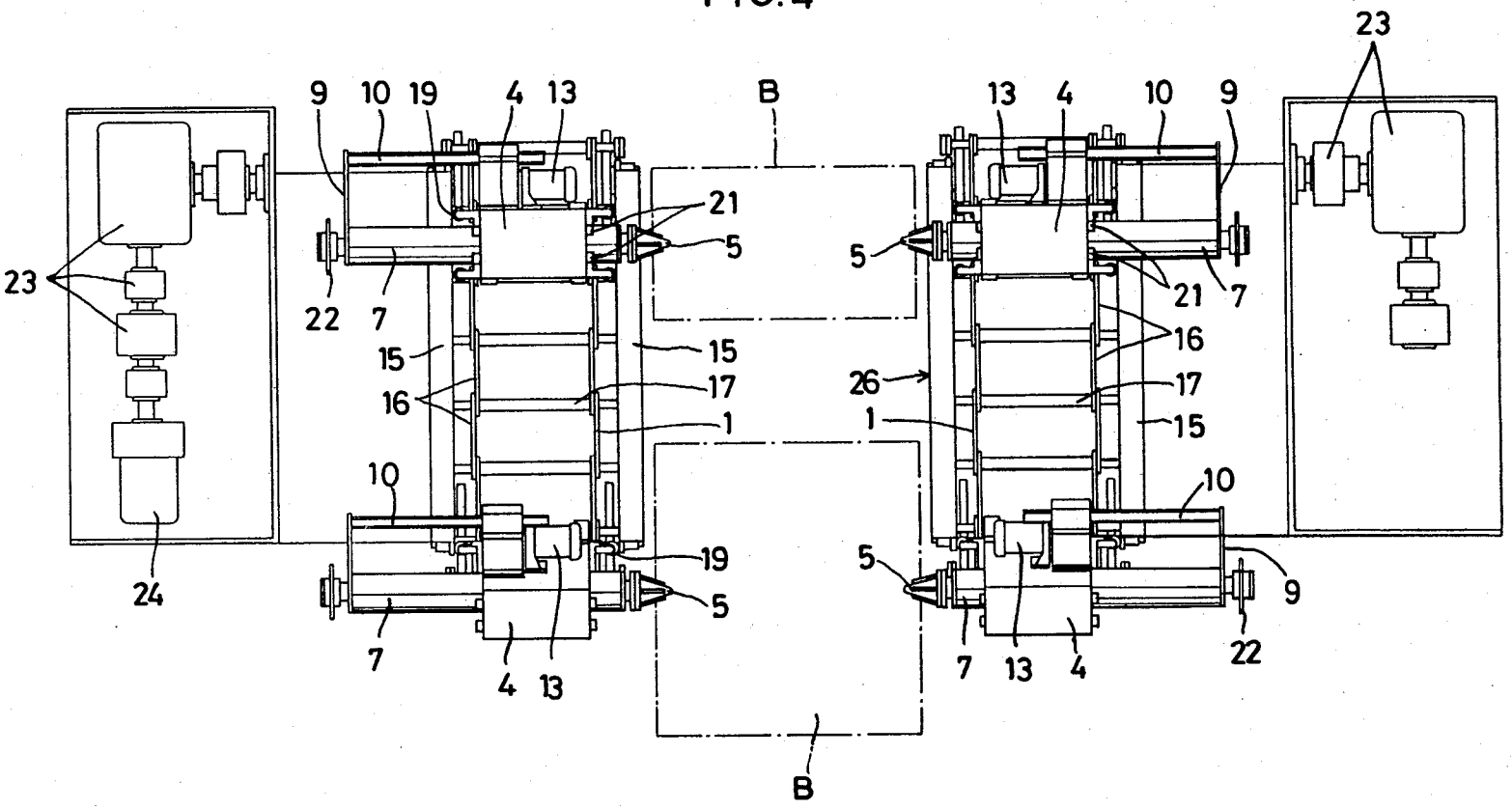
FIG. 4 is a plan view of the mill roll stand embodying the present invention.
Figure 5:
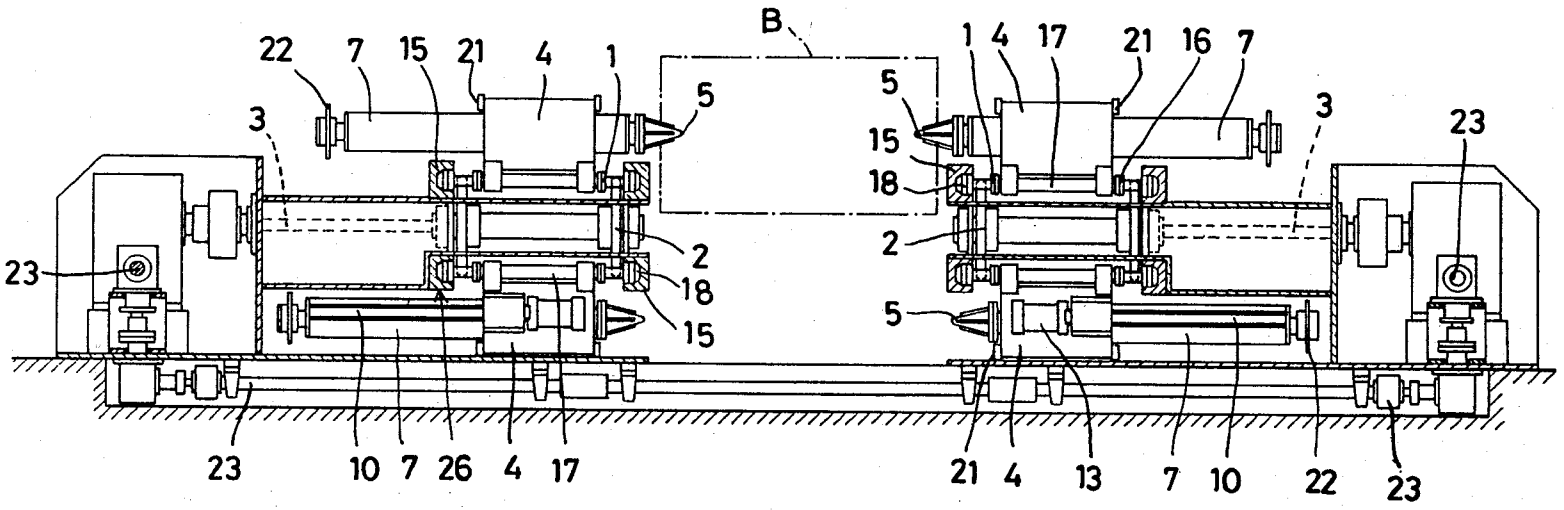
FIG. 5 is a vertical sectional front view of the same.

Referring now to the drawings, a pair of endless members 1 such as endless chains are provided with a larger spacing than the width of the roll B of web. Each endless chain passes around sprockets 2 supported at the inner end of a cantilever shaft 3 which is provided outside of the endless chain so as to be out of way of the web from the roll. (FIG. 5)

Figure 6:
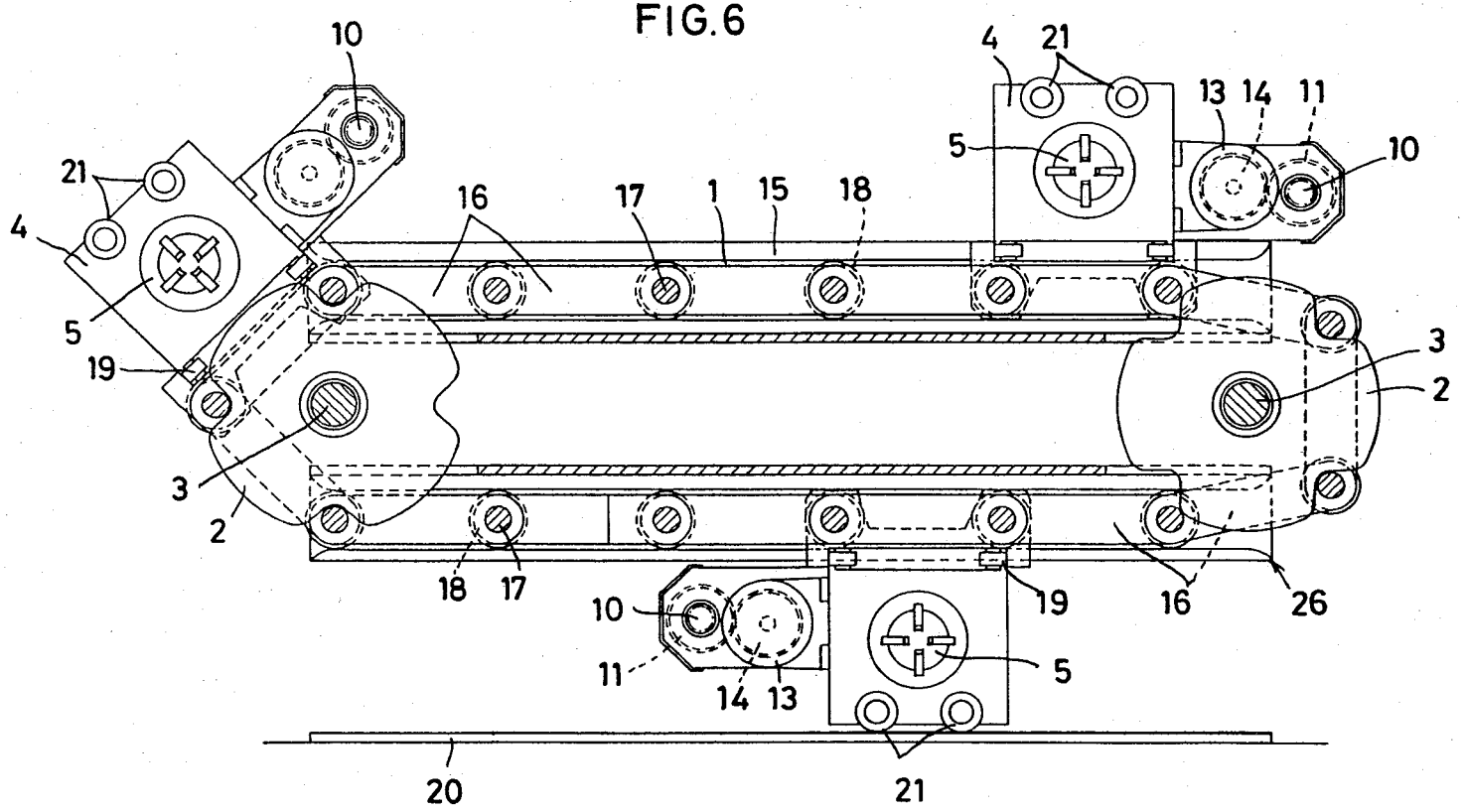
FIG. 6 is an enlarged vertical sectional side view of the same.

Three bases 4 for supporting the rolls B are mounted on each endless chain 1 at an equal spacing so as to be opposed to those mounted on the endless chain at the other side. (FIG. 6) Three pairs of the bases are provided in the preferred embodiment, but the number is not limited thereto.

Figure 7:
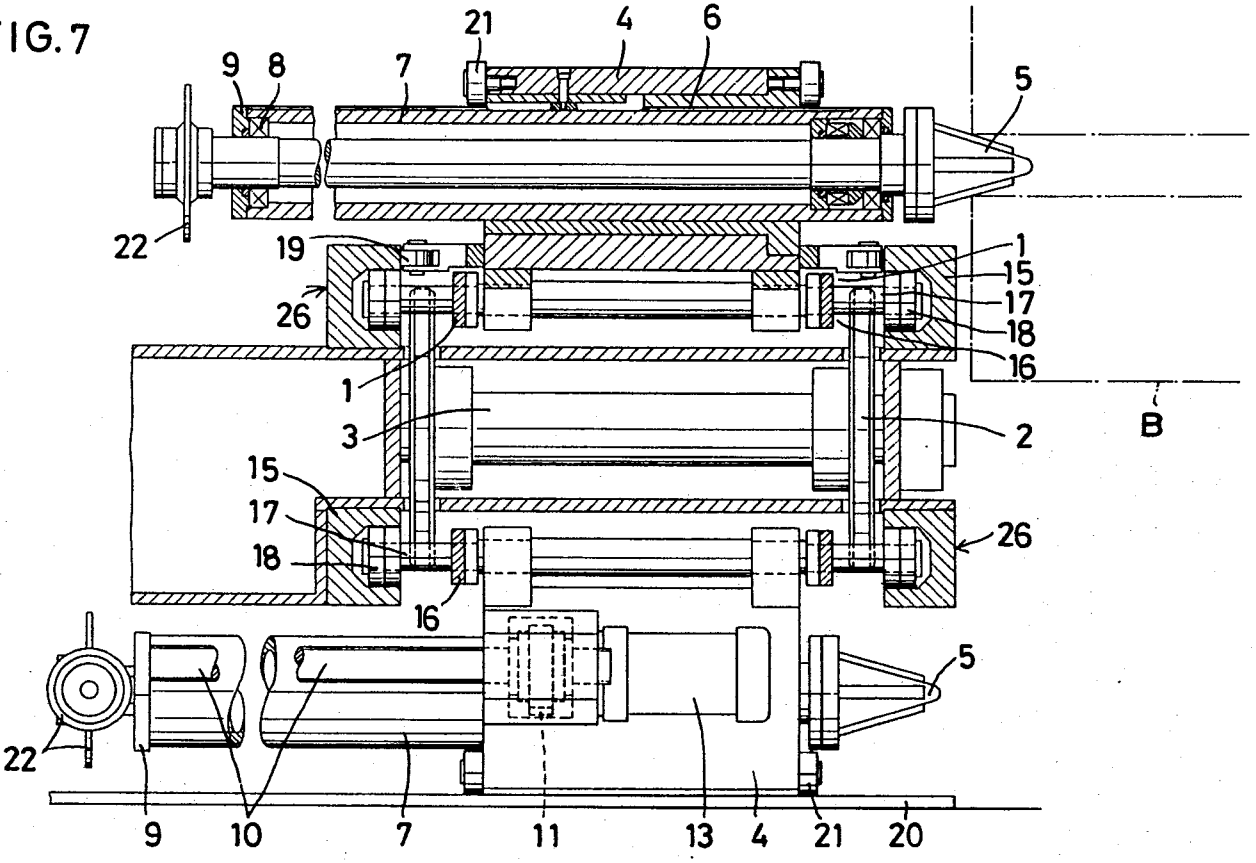
FIG. 7 is an enlarged vertical sectional front view of a portion of the same.

Each base 4 is provided with a center shaft 5 slidable toward and away from the center shaft of the base at the opposite side. The base 4 has a through hole 6 through which a slide pipe 7 extends. (FIG. 7) The center shaft 5 extends through the slide pipe 7, journalled by bearings 8 at each end of the slide pipe.

Figure 8:
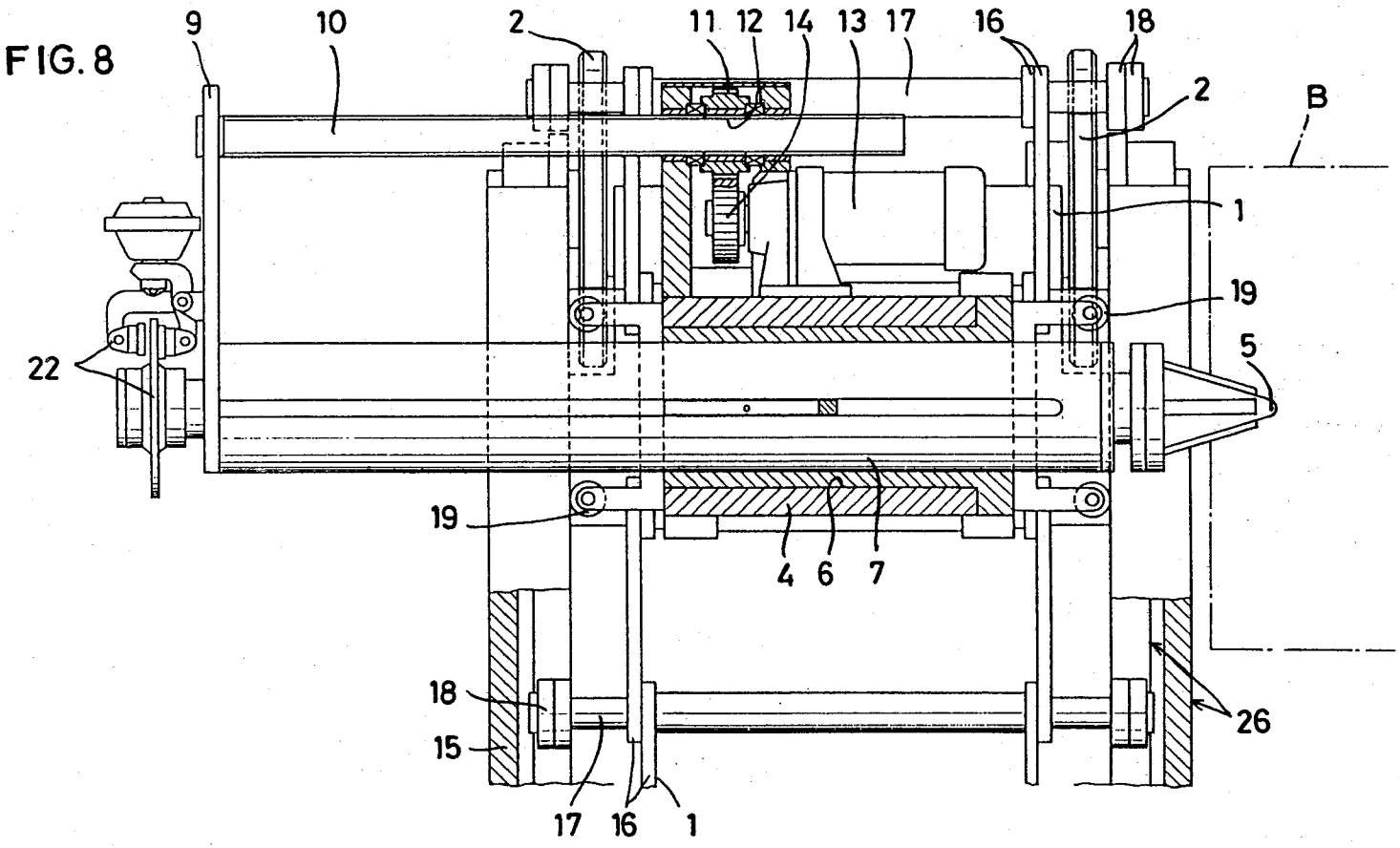
FIG. 8 is an enlarged horizontal sectional plan view of a portion of the same.

The center shaft 5 is given a sliding movement as follows. A mounting plate 9 is fixedly mounted on the slide pipe 7 at its outer end. A male threaded member 10 (FIG. 8) parallel to the slide pipe 7 has its outer end fixed to the mounting plate 9. A female threaded member 12 is threadedly mounted on the male threaded member 10 and journalled so as to turn at a fixed position. A gear 11 integral with the female threaded member 12 meshes with a gear 14 on the shaft of a reversible motor 13 supported on the base 4. When the motor starts, the female threaded member 12 turns. Because the male threaded member 10 is fixed to the mo unting plate 9, the slide pipe 7 and thus the center shaft 5 move to the right or the left. (FIG. 8)

At least the upper one of the parallel sections of each endless chain 1 is guided by a guide unit 26 (FIG. 7) to ensure that the endless chain runs along a predetermined line in spite of the heavy weight of the web roll supported on the base. In the preferred embodiment, the guide unit 26 comprises a pair of channel rails 15 and rollers 18 mounted on each end of coupling pins 17 for links 16 of which the endless chains 1 are comprised, said rollers rolling on said rails. It may also comprise a guide having a smooth surface on which the links 2 slide.

In the embodiment both of the upper and lower parallel sections of the endless chain 1 are guided by the guide units 26. But, only the upper one may be guided.

The bases 4 are provided at each side thereof with rollers 19 (FIG. 7) rolling on the rail 15 to prevent them from running out of true. Also, they are provided at each side thereof with rollers 21 (FIG. 7) rolling on a plate 20 to avoid undue effect of the weight of the base 4 and of the web roll B on the endless chain 1 and the shaft 3.

The center shaft 5, which can turn freely as the web roll turns, is provided with a brake 22 at one end thereof. The sprockets 2 for driving the endless chains 1 in a synchronous manner are driven through a transmission unit 23 from a motor 24.

Figure 9:
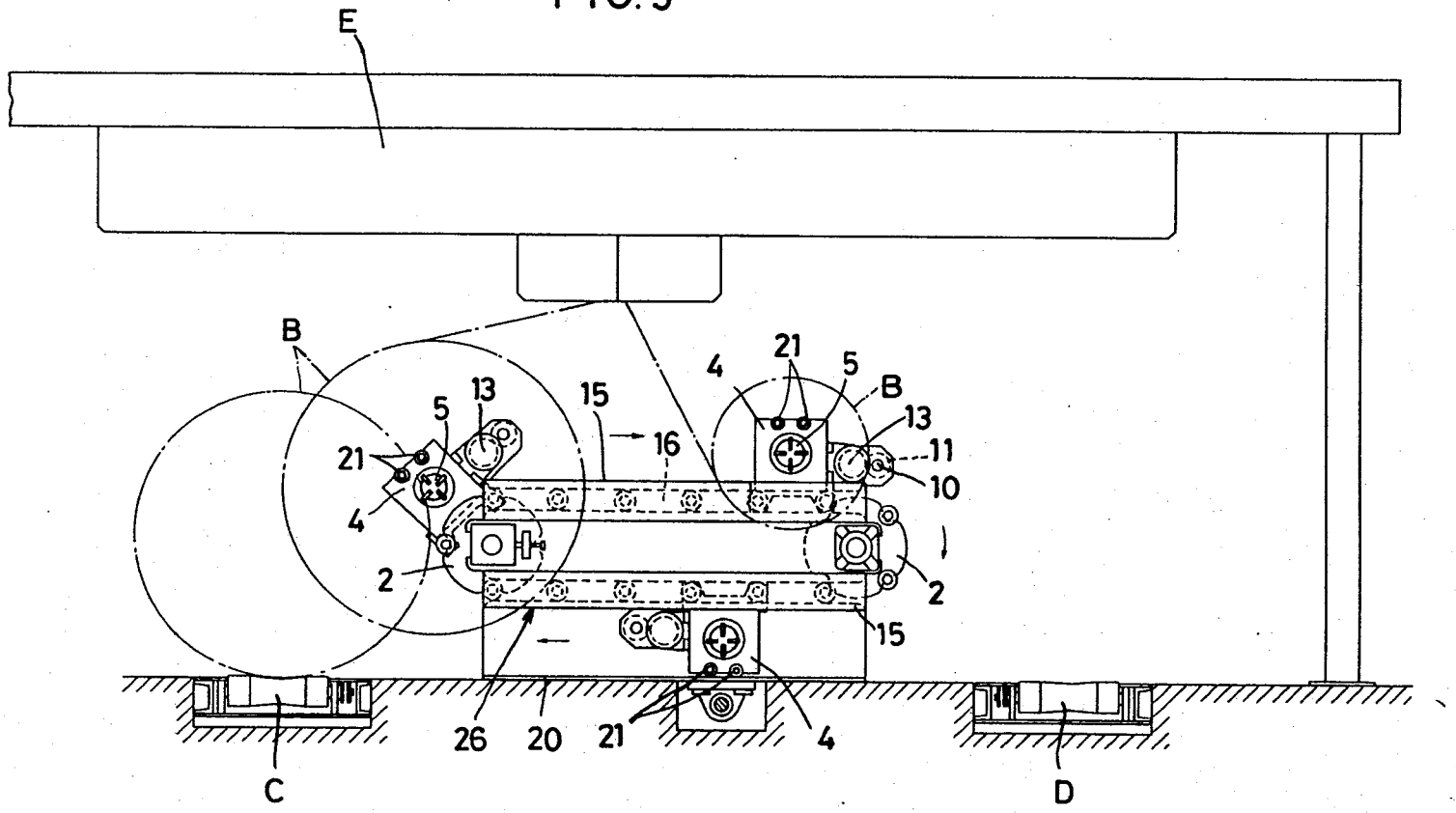
FIG. 9 is a side view showing the same in use.

The mill roll stand in accordance with the present invention is installed e.g. under a web splicer E in a corrugated fiberboard production line, as shown in FIG. 9.

In use, a roll of web is carried to one side of the mill roll stand on a supply conveyor C. One opposed pair of the bases 4 are moved to a position where the center shafts 5 are at the same level with the center hole in the web roll. The web roll B is then moved to between the pair of the bases manually, mechanically or by moving part of the conveyor C laterally.

When the motor 13 is started, the female threaded member 12 having the gear 11 meshing with the gear 14 on the motor shaft is turned so that the male threaded member 10 and the slide tube 7 and thus the center shaft 5 are moved inwardly (FIG. 8) until the center shaft is inserted into each end of the center hole in the web roll B. Now the web roll is supported on the center shafts 5 inserted thereinto from both ends thereof.

Then, the endless chain 1 is moved in the direction of arrow in FIG. 9 until the web roll comes at a predetermined position and the feeding of paper from the web roll to the corrugating machine is started.

To remove the web roll from the roll stand, the pair of the bases 4 is moved to the turning point of the endless chain 1 (as shown in FIG. 9) and the center shafts 5 are withdrawn out of the web roll. Conveniently, an inclined guide plate (not shown) may be provided between the sprocket 2 and a discharge conveyor D to guide the web roll to the conveyor D.

Although the preferred embodiment has three pairs of bases, two mill roll stands each having a single pair of bases in accordance with the present invention may be used instead.

The mill roll stand according to the present invention can support a plurality of paper rolls by providing as many pairs of bases so long as the space permits. Also, the rolls can be moved in a straight line or in a curve by selecting the manner of guiding suitably.

Although in the embodiment the bases are adapted to turn guided by endless chains, they may be adapted to reciprocate.

It will be understood from the foregoing that the mill roll stand according to the present invention can meet all the aforementioned requirements for a mill roll stand and is of a strain-free construction in comparison with the conventional mill roll stands having support arms for supporting a web roll or rolls.

What are claimed are:

1. A mill roll stand for supporting at least one roll of paper or similar web-like material, comprising:

a pair of endless members arranged with a spacing therebetween, at least one pair of bases mounted on said endless members so as to be opposed to each other, at least one pair of center shafts supported in said bases so as to be laterally slidable into and out of the center hole in the roll to be supported to hold said roll, drive means for driving said endless members in a synchronous manner, and guide means for guiding at least part of said endless members so that they will run in a predetermined route even under the weight of said web rolls.

2. The mill roll stand as claimed in claim 1 wherein said endless member is an endless chain comprising links and coupling pins for coupling said links, said guide means comprising channel rails and rollers mounted at each end of said coupling pins so as to roll in said channel rails.

* * * * *